US005524299A

United States Patent [19]

Dalfino

[11] Patent Number: 5,524,299

[45] Date of Patent: Jun. 11, 1996

[54] TOILET TANK WATER FLOW SHUTOFF APPARATUS FOR PREVENTING LEAKAGE AND OVERFLOW

[76] Inventor: Oronzo Dalfino, 118 E. 143rd Ave., Tampa, Fla. 33613

[21] Appl. No.: 423,201

[22] Filed: Apr. 17, 1995

[51] Int. Cl.[6] ..... E03D 1/00

[52] U.S. Cl. ..... 4/415; 4/366; 137/410

[58] Field of Search ..... 4/365, 366, 405, 4/415; 137/403, 410, 420

[56] References Cited

U.S. PATENT DOCUMENTS

| | | | |
|---|---|---|---|
| 3,619,821 | 11/1971 | Bobo | 4/366 |
| 4,110,849 | 9/1978 | La Faver | 4/415 X |
| 4,402,093 | 9/1983 | Luker et al. | 4/427 |
| 4,407,026 | 10/1983 | Myers | 4/365 |
| 4,498,203 | 2/1985 | Barnum et al. | 4/427 |
| 4,538,307 | 9/1985 | Barnum et al. | 4/427 |
| 4,843,657 | 7/1989 | Orr | 4/405 |
| 5,062,166 | 9/1991 | Krenecki | 4/427 |
| 5,230,104 | 7/1993 | Ocampo | 4/415 |
| 5,232,011 | 8/1993 | Royalty | 137/410 |

*Primary Examiner*—Charles E. Phillips
*Attorney, Agent, or Firm*—John R. Flanagan

[57] ABSTRACT

A toilet tank water flow shutoff apparatus for preventing leakage and overflows includes a fill tray mounted on an upper portion of a main frame inside a toilet tank. The fill tray receives water from a water inlet valve in the toilet tank and discharges the water concurrently as it is being received. The apparatus also includes a lever tank mounted on a lower portion of the main frame below the fill tray and undergoes pivotal movement between water retain and release positions. The lever tank operates a water inlet valve independent of the water level in the toilet tank.

20 Claims, 2 Drawing Sheets

TOILET TANK WATER FLOW SHUTOFF APPARATUS FOR PREVENTING LEAKAGE AND OVERFLOW

BACKGROUND OF THE INVENTION

1. Field of the Invention

The present invention generally relates to toilet tanks and, more particularly, is concerned with a toilet tank water flow shutoff apparatus for preventing leakage and overflow of toilet water.

2. Description of the Prior Art

Most toilets have a system of levers and valves in conjunction with a water holding tank to control water flow in and out of the toilet bowl proper. These systems are primarily necessary to prevent leakage and overflow of water after a flush. Most toilet tanks have a float that is movable with the water level in the tank during flush cycles. The float operates a water inlet valve that opens to refill the toilet tank upon lowering of the water from a predetermined level and closes once the tank has refilled to the predetermined level.

Actuation, usually by depression, of a flush lever causes unseating of a drain plug in the bottom of the tank during a flush cycle, causing the water in the tank to be released through a bottom discharge opening. The float descends in response to lowering of the water level from the predetermined level and operates to open the water inlet valve to initiate refilling of the tank with concurrent re-seating of the drain plug. As the toilet tank is refilled with water, the float ascends in response to the rise of the water level and when the water level returns to the predetermined level operates to close the water inlet valve to prevent any further supply of water to the toilet tank.

A problem exists where the water in the tank drops from the predetermined level due to a leak rather than a flush such as when the drain plug does not seat properly upon refilling of the tank. The leakage may be sporadic, continual or catastrophic. In any case, the float will operate the water inlet valve to remain open with water flowing into the tank to replace the water lost by the leak. If a backup or plugging situation should arise as a result of normal use of the toilet or external factors affecting the sewer system connected to the toilet, the presence of such leakage condition would likely result in overflow of water from the toilet bowl.

Various devices have been developed to address the problem of toilet overflows. Representative examples of such devices are disclosed in U.S. Pat. No. 4,402,093 to Luker et al., U.S. Pat. Nos. 4,498,203 and 4,538,307 to Barnum et al. and U.S. Pat. No. 5,062,166 to Krenecki. These devices, however, and do not address the problem of leaks.

Other devices address the problems of both toilet overflows and leaks. Representative examples of such devices are disclosed in U.S. Pat. No. 4,843,657 to Orr and U.S. Pat. No. 5,232,011 to Royalty. The Orr and Royalty devices operate only once the water level in the toilet tank reaches a predetermined level. Thus, if a leak occurs before the water reaches this particular level upon refilling after a flush, these devices would not shut off the water inlet valve in the toilet tank until such time as this predetermined level is reached.

Consequently, a need still exists for a toilet tank water leakage and overflow prevention system that will overcome the problems of the prior art without introducing new ones in their place.

SUMMARY OF THE INVENTION

The present invention provides a toilet tank water flow shutoff apparatus that is designed to satisfy the aforementioned need. The present invention provides a flow shutoff apparatus that is simple and low cost in construction, operates without regard to the amount of water in the toilet tank and thus offers a comprehensive solution for toilet leaks and overflows.

Accordingly, the present invention is directed to a toilet tank water flow shutoff apparatus for use with a toilet tank. The toilet tank has a water inlet valve mounted therein, a control lever disposed therein and being attached to the water inlet valve and movable between displaced positions to respectively actuate the water inlet valve between open and closed positions to respective initiate and shutoff flow of water into the toilet tank, and a flush lever mounted outside the toilet tank and being actuatable to initiate a flushing operation. The flow shutoff apparatus of the present invnetion comprises: (a) a support frame; (b) means for mounting the support frame to a toilet tank; (c) a fill tray mounted on an upper portion of the support frame, the fill tray including (i) means for receiving water from a water inlet valve in the toilet tank, and (ii) means for discharging water from the water receiving means; and (d) a lever tank for coupling to the flush lever on the outside of the toilet tank. The lever tank is mounted on a lower portion of the support frame to undergo pivotal movement from a water retain position to a water release position and allow displacement of the control lever to cause actuation of the water inlet valve in the toilet tank from the closed position to the open position initiating flow of water into the toilet tank and fill tray in response to actuation of the flush lever to initiate a flushing operation. The lever tank also is disposed below the fill tray to receive water discharging from the water receiving means of the fill tray and to undergo pivotal movement from the water release position to the water retain position and cause displacement of the control lever to cause actuation of the water inlet valve from the open position to the closed position shutting off flow of water into the toilet tank and fill tray in response to the lever tray receiving a predetermined quantity of water from the fill tray.

More particularly, the water receiving means of the fill tray includes a receptacle for holding water and an inlet nozzle attached to the receptacle and connected to the water inlet valve for controlling flow of water from the water inlet valve into the receptacle. The water discharging means of the fill tray is an orifice defined in the receptacle that permits water to discharge from the receptacle into the lever tank below the fill tray at a rate slower than water is received into the receptacle through the inlet nozzle.

Further, the lever tank includes a pair of vertical sidewalls each having front and rear ends and decreasing progressively in height from the rear end to the front end, a vertical end wall extending between and connected to rear ends of the vertical sidewalls, and a bottom wall extending between the front and rear ends of the vertical sidewalls and connected to lower edge portions thereof. The bottom wall also is connected to a lower edge portion of the vertical end wall and extends at a forwardly and upwardly inclination therefrom so as to define a cavity in the lever tank into which to receive and hold water when the lever tank is in the water retain position and from which to discharge water over a front end of the bottom wall when the lever tank is in the water release position. The lever tank also includes means for pivotally coupling the sidewalls of the lever tank to the support frame.

The lever tank is pivotally moved to the water release position in response to actuation by a user of a flush lever on the outside of the toilet tank to initiate a flushing operation. As the lever tank reaches the water release position, the front end of the bottom wall of the lever tank disengages from the control lever and releases an application of force thereon which actuates the water inlet valve to the open position, initiating flow of water from the water inlet valve into both the toilet tank and fill tray. The lever tank pivotally moves to the water retain position in response to water being discharged therein from the fill tray reaching a predetermined quantity. As the lever tank reaches the water retain position, the front end of the bottom wall of the lever tank engages the control lever and applies a force thereon which actuates the water inlet valve to the closed position, shutting off flow of water from the water inlet valve into the toilet tank and fill tray. The lever tank thus shuts off the water inlet valve independent of what water level is reached in the toilet tank so that further flow of water into the toilet tank is terminated and so are leaks which would cause the water in the toilet tank not to reach a predetermined level.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
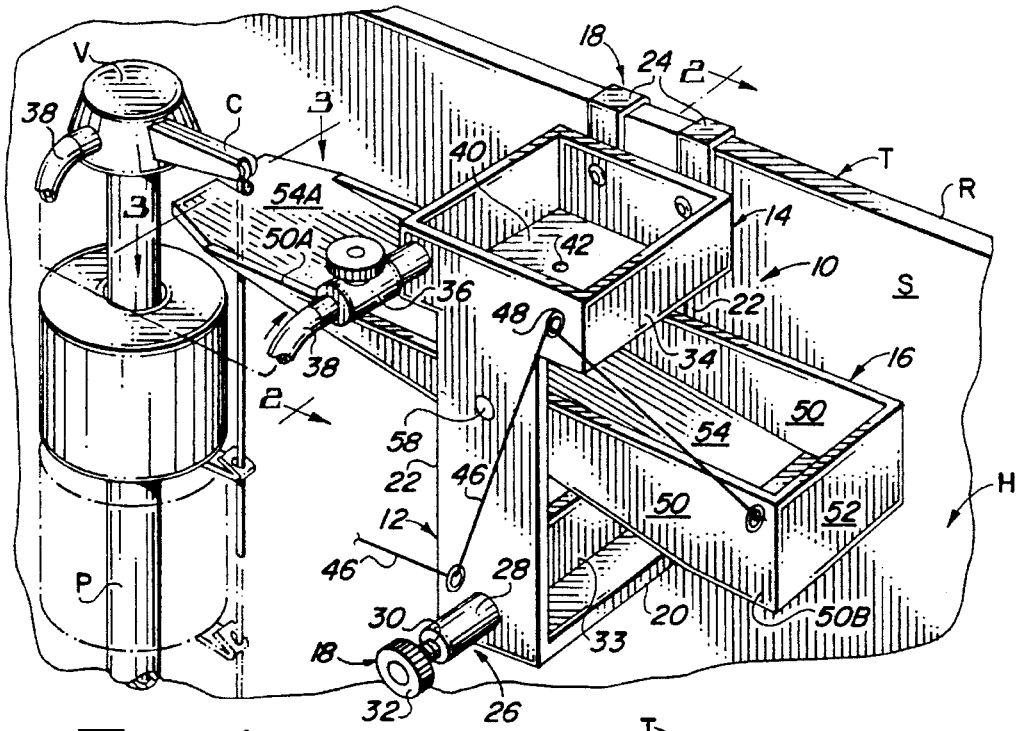
FIG. 1 is a perspective view of a water flow shutoff apparatus of the present invention mounted in a conventional toilet tank.
Figure 2:
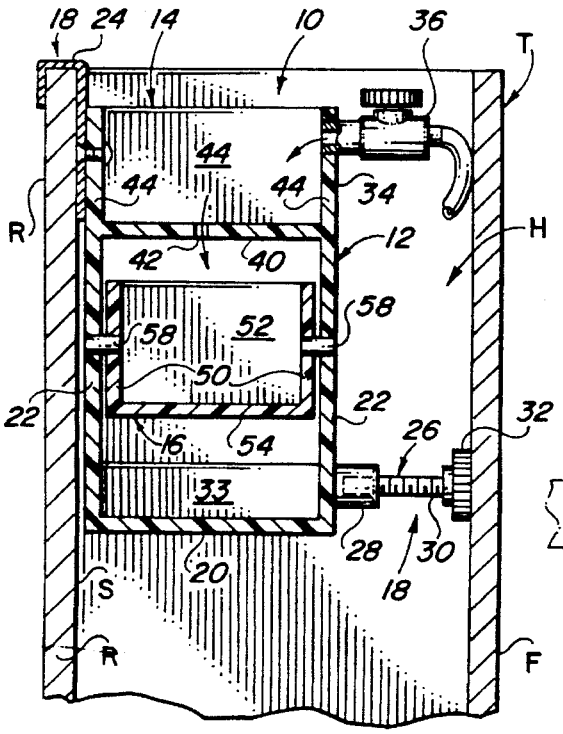
FIG. 2 is a cross-sectional view of the flow shutoff apparatus taken along line 2—2 of FIG. 1.
Figure 1A:
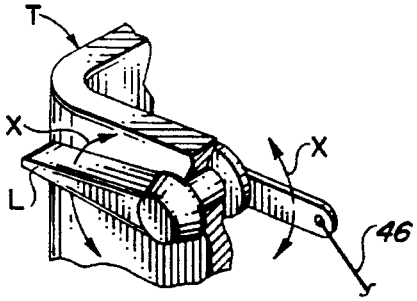
FIG. 1A is a perspective view of a conventional flush lever on the outside the toilet tank which actuates the movement of a lever tank of the flow shutoff system to a water release position.
Figure 3:
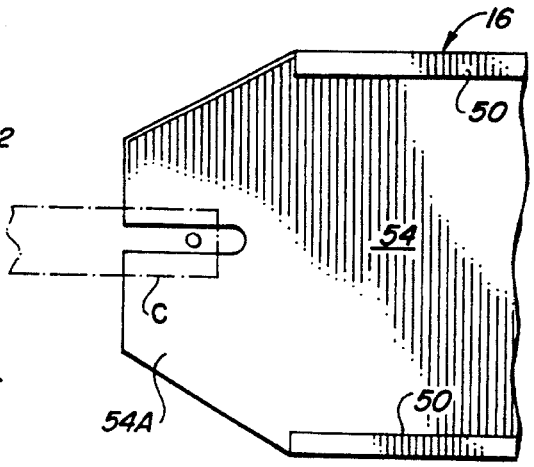
FIG. 3 is an enlarged fragmented top plan view of the upper end of the lever tank of the flow shutoff apparatus as seen along line 3—3 of FIG. 1.

Referring to the drawings and particularly to FIGS. 1, 1A and 2, there is illustrated a toilet tank water flow shutoff apparatus of the present invention, being generally designated 10, employed in conjunction with a holding tank T of a conventional toilet for preventing leakage and overflows therefrom. The toilet tank T conventionally has a water inlet valve V mounted therein at the top of an inflow standpipe P and a control lever C disposed in the toilet tank T and attached to the water inlet valve V. The control lever C is movable between vertically disposed down and up displaced positions, as seen respectively in FIGS. 4 and 6, to respectively actuate the water inlet valve V between open and closed positions to correspondingly initiate and shutoff flow of water into the toilet tank T. As shown in FIG. 1A, the toilet tank T also has a flush lever L pivotally mounted thereon and being actuatable counterclockwise by a user to initiate a flushing operation.

Referring to FIGS. 1 and 2, the flow shutoff apparatus 10 basically includes a support frame 12, a fill tray 14 mounted on an upper portion of support frame 12, and a lever tank 16 mounted on a lower portion of the support frame 12. The apparatus 10 also includes means 18 for mounting the support frame 12 to the toilet tank T to dispose the support frame 12 inside of the toilet tank T and hang it along an inside surface S of a rear wall R of the toilet tank T.

The support frame 12 of the flow shutoff apparatus 10 is a rigid U-shaped structure being constructed of a transverse lower member 20 and a pair of upright side members 22 attached to opposite ends of and extending upwardly from the transverse lower member 20. The fill tray 14 is formed and mounted between upper portions of the upright side members 22 of the support frame 12. The lever tank 16 is disposed below the fill tray 14 and pivotally mounted between lower portions of the upright side members 22 and above the transverse lower member 20 of the support frame 12.

The frame mounting means 18 of the flow shutoff apparatus 10 includes a pair of hook-shaped mounting brackets 24 attached to a first one of the upright support members 22 the support frame and fitted over the top edge of the rear wall R of the toilet tank T so as to hang the support frame 12 along the interior side or inside surface S at the rear wall R and in the interior water holding compartment H of the toilet tank T. The frame mounting means 18 also includes a spacer member 26 in the form of an internally-threaded sleeve 28 attached to the exterior of the opposite second one of the upright support members 22 of the frame 12 and an externally-threaded rod 30 threaded at one end into the sleeve 28 and having an end knob 32. By turning the knob 32, the end of the rod 30 can be threaded into or from the sleeve 28 so as to adjust and preset the length of the spacer member 26 extending between the second one of the upright support members 22 of the frame 12 and a front wall F of the toilet tank T to fill the space therebetween and tightly hold the support frame 12 against the rear wall R of the toilet tank T. The support frame 12 includes a cross member 33 which extends between and is attached at opposite ends to the side members 22 in general alignment with the spacer member 26 so as to prevent the support frame 12 from becoming distorted or twisted and thus giving lateral support to the support frame 12 when the spacer member 26 is tightened in place.

The fill tray 14 of the apparatus 10 includes means for receiving water from the water inlet valve V and means for discharging water from the water receiving means. The water receiving means includes a generally rectangular-shaped receptacle 34 for receiving and temporarily holding water and an inlet nozzle 36 attached to the receptacle 34 and interconnected via a flexible hose 38 to the water inlet valve V. The inlet nozzle 36 has an adjustment member for controlling the flow of water from the water inlet valve V into the receptacle 34. The receptacle 34 includes a base wall 40 having a water discharging means defined therein preferably in the form of an orifice 42 and a plurality of vertical walls 44 fixedly connected to one another and to the base wall 40 and extending upwardly therefrom. The water discharging orifice 42 defined in the base wall 40 of the receptacle preferably has a predetermined size that permits water to discharge from the receptacle into the lower lever tank 16 at a rate slower than the rate by which water is received into the receptacle 34 through the inlet nozzle 36 so that it will take a preselected period of time for the lever tank 16 to fill.

Figure 4:
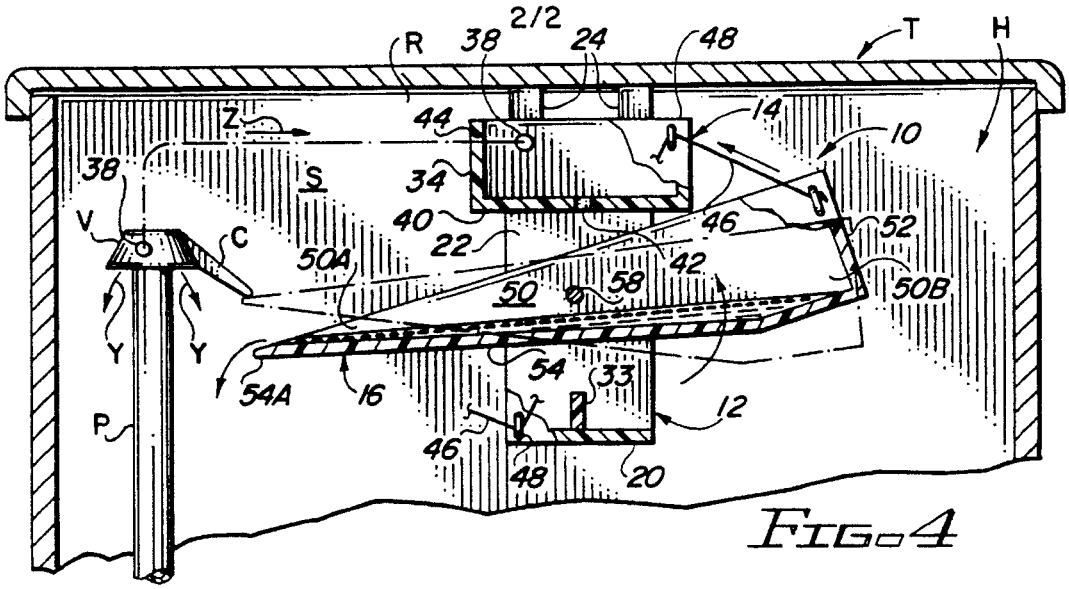
FIG. 4 is a vertical sectional view of the flow shutoff apparatus showing the lever tank of the apparatus in the water release position disengaged from a control lever of a water inlet valve in the toilet tank with the latter in an open position.
Figure 5:
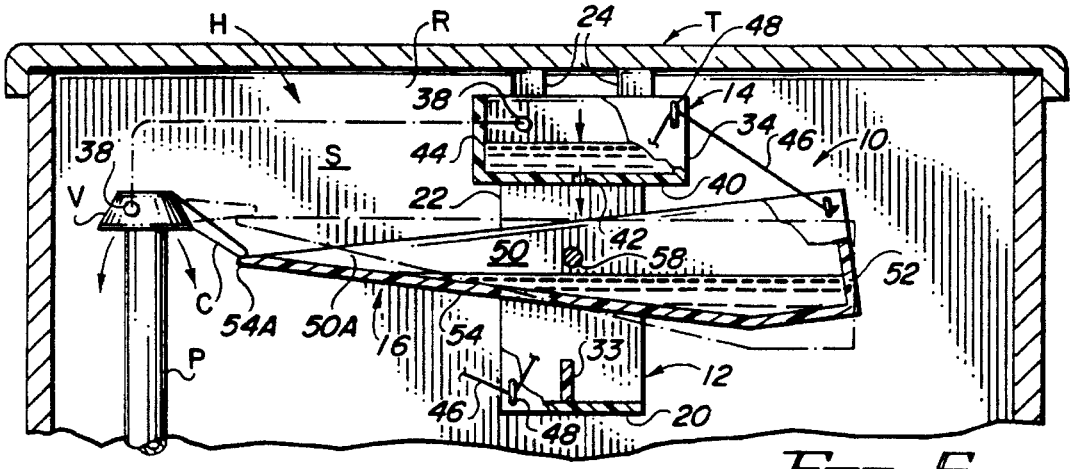
FIG. 5 is another vertical sectional view of the flow shutoff apparatus showing the lever tank of the apparatus in an initial position engaging the control lever of the water inlet valve for starting to receive water from a fill tray of the apparatus.
Figure 6:
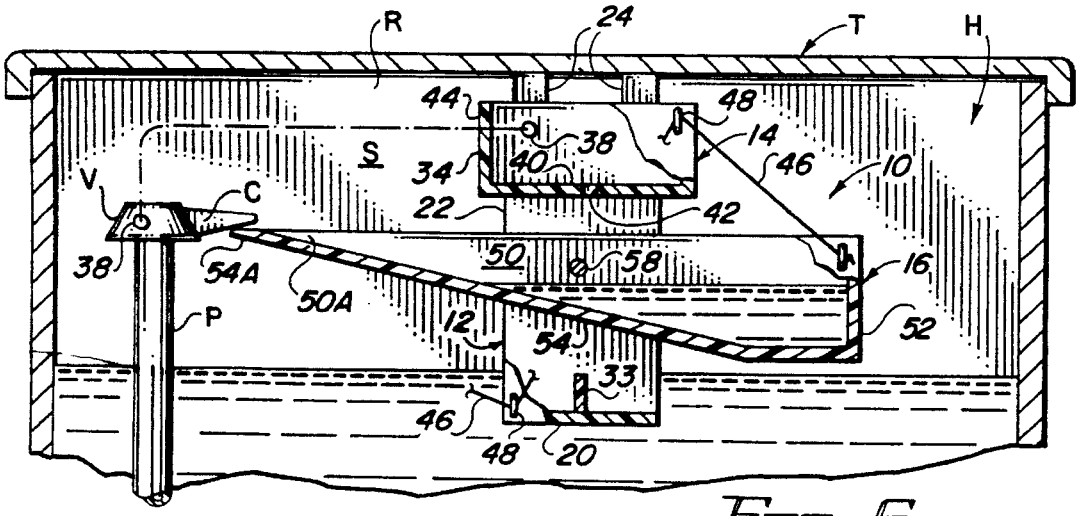
FIG. 6 is still another vertical sectional view of the flow shutoff apparatus showing the lever tank of the apparatus having pivoted to a water retain position where the lever tank engages and holds the control lever of the water inlet valve in a closed position.

Referring to FIGS. 1, 1A, 2 and 3, the lever tank 16 of the flow shutoff apparatus 10 is seen coupled to the flush lever L by a flexible line 46 extending from the end of a portion of the flush lever L disposed inside of the toilet tank T, through eyelets 48 attached on the outside of a portion of the support frame 12 which forms part of the receptacle 34 also, to a rearward portion of the lever tank 16. The lever tank 16 includes a pair of vertical sidewalls 50, a vertical rear end wall 52 and a bottom wall 54. Each sidewall 50 has spaced front and rear ends 50A, 50B and decreases progressively in height from the rear end 50B to the front end 50A thereof. The vertical rear end wall 52 extends between and is fixedly connected to rear ends 50B of the vertical sidewalls 50. The bottom wall 54 extends between the front and rear ends 50A, 50B of the vertical sidewalls 50 and is connected to lower edge portions thereof. The bottom wall 54 also is connected to a lower edge portion of the vertical rear end wall 52 and extends at a forwardly and upwardly inclination therefrom so as to define a cavity in the lever tank 16 into which to receive water and to hold water when the lever tank 16 is in the water retain position, as seen in FIGS. 5 and 6, and from which to discharge water over a front end 54A of the bottom wall 54 when the lever tank 16 is in a water release position, as seen in FIG. 4. The lever tank 16 also includes means in the form of a pair of pivot pins 58 attached to the sidewalls 50 of the lever tank 16 at aligned middle locations thereon spaced from the front and rear ends 50A, 50B. The pivot pins 58 extend outwardly therefrom and into holes in the first and second upright side members 22 of the support frame 12 for pivotally coupling the lever tank 16 at its sidewalls 50 between and to the upright side members 22 of the support frame 12 such that the lever tank 16 is disposed below the receptacle 34 of the fill tray 14 and the rear portion of the lever tank 16 to the right of the pivot pins 58 as viewed in FIGS. 4–6 is heavier than the front portion of the lever tank 16 to the left of the pivot pins 58 whereby the lever tank 16 due to the afore-describd offset of its center of gravity will want to rotate in a clockwise direction and force the front end 54A upwardly into engagement with the control lever C of the water inlet valve V and hold it in a closed (shutoff) position.

Referring to FIGS. 4–6, therefore, the lever tank 16 is mounted on the support frame 12 to undergo pivotal movement relative thereto. Pivotal movement of the lever tank 16 in a counterclockwise direction about the pivot pins 58 from the water retain position of FIG. 6 to the water release position of FIG. 4, which occurs in response to depressing the flush lever L in the direction of arrow X in FIG. 1A to initiate flushing of the toilet, allows displacement of the control lever C from the up position (FIG. 6) to the down position (FIG. 4) which causes actuation of the water inlet valve V from the closed shutoff position to the open fill position. Such actuation of the water inlet valve V initiates flow of water into the toilet tank, as indicated by arrows Y in FIG. 4, and into the fill tray 14, as indicated by arrow Z in FIG. 4. As soon as the flush lever F is released, the lever tank 16 due to its offset center of gravity will start to pivotally move in a clockwise direction back toward its water retain position. Furthermore, as it starts to receive water discharging from the bottom discharge orifice 42 of the fill tray 14, as depicted in FIG. 5, the lever tank 16 will continue to undergo clockwise pivotal movement from the water release position toward the water retain position and engage and apply a force to displace the control lever C from its down position toward its up position to cause actuation of the water inlet valve V from its open position toward its closed position. Upon reaching the final water retain position of FIG. 6 when a predetermined quantity of water has filled the cavity of the lever tank 16, the lever tank 16 has further pivoted clockwise and fully displaced the control lever C to its up position and caused actuation of the water inlet valve V to the closed position, shutting off further flow of water therefrom into the toilet tank T and into the fill tray 14 and therefrom to the lever tank 16.

To recapitulate, the lever tank 16 is pivotally moved to the water release position in response to actuation by a user of the flush lever L on the outside of the toilet tank T to initiate a flushing operation. As the lever tank 16 pivotally moves toward its water release position, the front end 54A of the bottom wall 54 of the lever tank 16 disengages from the control lever C and releases an application of force thereon which actuates the water inlet valve V to the open position, initiating flow of water from the water inlet valve V into both the toilet tank T and fill tray 14. The lever tank 16 then reverses and pivotally moves toward the water retain position in response to water being discharged therein from the fill tray 14. As the lever tank 16 receives and fills with the predetermined quantity of water and moves toward the water retain position, the front end 54A of the bottom wall 54 of the lever tank 16 engages the control lever C and applies a lifting force thereon which actuates the water inlet valve V toward the closed position, shutting off flow of water from the water inlet valve V into the toilet tank T and fill tray 14 when the control lever C reaches the up position. The lever tank 16 thus shuts off the water inlet valve V independent of what water level is reached in the toilet tank T but only in response to the desired predetermined quantity of water is receivd in the lever tank 16 so that further flow of water into the toilet tank T is terminated and so are any leaks which would cause the water in the toilet tank T not to reach a predetermined level.

It is though that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A toilet tank water flow shutoff apparatus for use with a toilet tank having a water inlet valve mounted therein, a control lever disposed therein and being attached to the water inlet valve and movable between displaced positions to respectively actuate the water inlet valve between open and closed positions to respective initiate and shutoff flow of water into the toilet tank, and a flush lever mounted outside the toilet tank and being actuatable to initiate a flushing operation, said apparatus comprising:

(a) a support frame;

(b) means for mounting said support frame to the toilet tank;

(c) a fill tray mounted on an upper portion of said support frame, said fill tray including (i) means for receiving water from a water inlet valve in the toilet tank, and (ii) means for discharging water from said water receiving means; and (d) a lever tank (being coupled) to the flush lever, said lever tank being mounted on a lower portion of said support frame to undergo pivotal movement from a water retain position to a water release position and allow displacement of the control lever to cause actuation of the water inlet valve in the toilet tank from the closed position to the open position initiating flow of water into the toilet tank and said fill tray in response to actuation of the flush lever to initiate a flushing operation, said lever tank also being disposed below said fill tray to receive water discharging from said means for discharging water of said fill tray and to undergo pivotal movement from said water release position to said water retain position and cause displacement of the control lever to cause actuation of the water inlet valve from the open position to the closed position shutting off flow of water into the toilet tank and said fill tray in response to said lever tray receiving a predetermined quantity of water from said fill tray.

2. The apparatus of claim 1 wherein said water receiving means of said fill tray includes:

a receptacle for holding water; and an inlet nozzle attached to said receptacle and interconnected to the water inlet valve for controlling flow of water from the water inlet valve into said receptacle.

3. The apparatus of claim 2 wherein said water discharging means of said fill tray is an orifice defined in said receptacle having a predetermined size that permits water to discharge from said receptacle into said lever tank at a rate slower than water is received into said receptacle through said inlet nozzle.

4. The apparatus of claim 2 wherein said receptacle of said fill tray includes:

a base wall having said water discharging means defined therein; and a plurality of vertical walls connected to one another and to said base wall and extending upwardly therefrom.

5. The apparatus of claim 1 wherein said lever tank includes:

a pair of vertical sidewalls each having front and rear ends and decreasing progressively in height from said rear end to said front end;

a vertical end wall extending between and connected to rear ends of said vertical sidewalls; and a bottom wall extending between said front and rear ends of said vertical sidewalls and connected to lower edge portions thereof, said bottom wall also being connected to a lower edge portion of said vertical end wall and extending at a forwardly and upwardly inclination therefrom so as to define a cavity in said lever tank into which to receive and hold water when said lever tank is in said water retain position and from which to discharge water over a front end of said bottom wall when said lever tank is in said water release position.

6. The apparatus of claim 5, wherein said lever tank also includes means for pivotally coupling said sidewalls of said lever tank to said support frame.

7. The apparatus of claim 1 wherein said support frame includes:

a transverse lower member; and a pair of upright side members attached to opposite ends of and extending upwardly from said transverse lower member, said fill tray being formed between upper portions of said upright side members, said lever tank being mounted below said fill tray between lower portions of said upright side members and above said transverse lower member.

8. The apparatus of claim 7 wherein:

said water receiving means of said fill tray includes (i) a receptacle for holding water being mounted between upper portions of said upright side members of said support frame, said water discharging means of said fill tray is an orifice defined in said receptacle, and (ii) an inlet nozzle attached to said receptacle and interconnected to the water inlet valve for controlling flow of water from the water inlet valve into said receptacle; and said water discharging means of said fill tray is an orifice defined in said receptacle.

9. The apparatus of claim 8 wherein said orifice defined in said receptacle has a predetermined size that permits water to discharge from said receptacle into said lever tank at a rate slower than water is received into said receptacle through said inlet nozzle.

10. The apparatus of claim 9 wherein said receptacle of said fill tray includes:

a base wall having said water discharging means defined therein; and a plurality of vertical walls connected to one another and to said base wall and extending upwardly therefrom.

11. The apparatus of claim 8 wherein said lever tank includes:

a pair of vertical sidewalls each having front and rear ends and decreasing progressively in height from said rear end to said front end;

a vertical end wall extending between and connected to rear ends of said vertical sidewalls; and a bottom wall extending between said front and rear ends of said vertical sidewalls and connected to lower edge portions thereof, said bottom wall also being connected to a lower edge portion of said vertical end wall and extending at a forwardly and upwardly inclination therefrom so as to define a cavity in said lever tank into which to receive and hold water when said lever tank is in said water retain position and from which to discharge water over a front end of said bottom wall when said lever tank is in said water release position.

12. The apparatus of claim 11, wherein said lever tank also includes means for pivotally coupling said sidewalls of said lever tank between and to said upright side members of said support frame such that said lever tank is disposed below said receptacle of said fill tray.

13. In combination with a toilet tank, a water inlet valve mounted inside of said toilet tank, a control lever disposed inside of said toilet tank and being attached to said water inlet valve and movable between displaced positions to respectively actuate said water inlet valve between open and closed positions to respective initiate and shutoff flow of water into said toilet tank, and a flush lever mounted outside said toilet tank and being actuatable to initiate a flushing operation, a toilet tank water flow shutoff apparatus, comprising:

(a) a support frame;

(b) means for mounting said support frame to said toilet tank to dispose said support frame inside of said toilet tank;

(c) a fill tray mounted on an upper portion of said support frame, said fill tray including (i) means for receiving water from said water inlet valve, and (ii) means for discharging water from said water receiving means; and (d) a lever tank coupled to said flush lever and being mounted on a lower portion of said support frame to undergo pivotal movement from a water retain position to a water release position and allow displacement of said control lever to cause actuation of said water inlet valve from said closed position to said open position initiating flow of water into said toilet tank and fill tray in response to actuation of said flush lever to initiate a flushing operation, said lever tank also being disposed below said fill tray to receive water discharging from said means for discharging water of said fill tray and to undergo pivotal movement from said water release position to said water retain position and cause displacement of said control lever to cause actuation of said water inlet valve from said open position to said closed position shutting off flow of water into said toilet tank and fill tray in response to said lever tray receiving a predetermined quantity of water from said fill tray.

14. The combination of claim 13 wherein said mounting means includes at least one hook-shaped mounting bracket attached to said support frame and to a first wall of said toilet tank to hang said support frame along an interior side of said first wall and in an interior compartment of said toilet tank.

15. The combination of claim 14 wherein said mounting means also includes a spacer member mounted to said support frame and extending therefrom to a second wall of said toilet tank being opposite from said first wall thereof, said spacer member being adjustable in length to thereby preset said length of said spacer member to fill the space between said support frame and said second wall of said toilet tank.

16. The combination of claim 13 wherein said water receiving means of said fill tray includes:

a receptacle for holding water; and an inlet nozzle attached to said receptacle and interconnected to said water inlet valve for controlling flow of water from said water inlet valve into said receptacle.

17. The combination of claim 13 wherein said lever tank includes:

a pair of vertical sidewalls each having front and rear ends and progressively decreasing in height from said rear end to said front end;

a vertical end wall extending between and connected to rear ends of said vertical sidewalls; and a bottom wall extending between said front and rear ends of said vertical sidewalls and connected to lower edge portions thereof, said bottom wall also being connected to a lower edge portion of said vertical end wall and extending at a forwardly and upwardly inclination therefrom so as to define a cavity in said lever tank into which to receive and hold water when said lever tank is in said water ratain position and from which to discharge water over a front end of said bottom wall when said lever tank is in said water release position, said front end of said bottom wall being engaged with said control lever with said lever tank disposed in said water retain position of said lever tank and disengaged from said control lever with said lever tank disposed in said water release position.

18. The combination of claim 17, wherein said lever tank also includes means for pivotally coupling said sidewalls of said lever tank to said main frame.

19. The combination of claim 17 wherein as said lever tank pivotally moves to and reaches said water release position in response to actuation of said flush lever to initiate a flushing operation, said front end of said bottom wall of said lever tank disengages from and releases an application of force on said control lever which actuates said water inlet valve to said open position to permit water to flow from said water inlet valve into both said toilet tank and fill tray.

20. The combination of claim 19 wherein as said lever tank pivotally moves to and reaches said water retain position in response to water therein reaching said predetermined quantity, said front end of said bottom wall of said lever tank engages said control lever and applies force thereon which actuates said water inlet valve to said closed position, shutting off flow of water from said water inlet valve into both said toilet tank and fill tray.

* * * * *